US007762800B2

(12) United States Patent
Geus et al.

(10) Patent No.: US 7,762,800 B2
(45) Date of Patent: Jul. 27, 2010

(54) APPARATUS FOR MAKING A SPUNBOND WEB

(75) Inventors: Hans-Georg Geus, Niederkassel (DE); Detlef Frey, Niederkassel (DE)

(73) Assignee: Reifenhaeuser GmbH & Co. KG Maschinenfabrik, Troisdorf (DE)

( * ) Notice: Subject to any disclaimer, the term of this patent is extended or adjusted under 35 U.S.C. 154(b) by 0 days.

(21) Appl. No.: 12/146,573

(22) Filed: Jun. 26, 2008

(65) Prior Publication Data

US 2009/0004313 A1 Jan. 1, 2009

(30) Foreign Application Priority Data

Jun. 29, 2007 (EP) ..... 07012793

(51) Int. Cl.
*D01D 5/092* (2006.01)
*D01D 5/098* (2006.01)

(52) U.S. Cl. ..... 425/66; 425/72.2; 425/382.2; 425/464

(58) Field of Classification Search ..... 425/66, 425/72.2, 382.2, 464
See application file for complete search history.

(56) References Cited

U.S. PATENT DOCUMENTS 4,820,142 A * 4/1989 Balk ..... 348/97
5,397,413 A * 3/1995 Trimble et al. ..... 156/167
5,460,500 A * 10/1995 Geus et al. ..... 425/66
5,503,784 A * 4/1996 Balk ..... 264/40.3
5,648,041 A * 7/1997 Rodgers et al. ..... 264/555
5,814,349 A * 9/1998 Geus et al. ..... 425/66
6,379,136 B1 4/2002 Najour et al. ..... 425/66
6,918,750 B2 7/2005 Geus ..... 425/66
2003/0178742 A1 9/2003 Geus et al. ..... 264/211.22
2010/0062672 A1* 3/2010 Fare' ..... 442/409

FOREIGN PATENT DOCUMENTS

DE 3736418 11/1988

* cited by examiner

*Primary Examiner*—Robert B Davis
*Assistant Examiner*—Joseph Leyson
(74) *Attorney, Agent, or Firm*—Andrew Wilford

(57) ABSTRACT

An apparatus for making a spunbond web has a deposition surface, a spinneret above the surface for producing filaments that move downward along a path toward the surface, and a cooling chamber below the spinneret. Cool process air is supplied to the chamber to cool the filaments as they pass downward through the chamber. A laterally closed stretching unit downstream of the cooling chamber has laterally closed side walls that have portions that diverges downward. A connecting region between the stretching unit and the cooling chamber substantially excludes access of air from outside to the filaments as they pass from the cooling chamber to the stretching unit so that the filaments drop from the stretching unit onto the deposition surface.

10 Claims, 2 Drawing Sheets

APPARATUS FOR MAKING A SPUNBOND WEB

FIELD OF THE INVENTION

The present invention relates to an apparatus for making a spunbond web. More particularly this invention concerns such a web of thermoplastic filaments.

BACKGROUND OF THE INVENTION

An apparatus of the above-mentioned type is known in different embodiments. The filaments are spun first with the help of a spinneret, and then are usually passed down through a cooling chamber. After cooling, the filaments or the filament bundle reach a stretching passage of a stretching unit in which they are stretched aerodynamically. The transverse width of the stretching passage in the machine or travel direction of the spinning fleece is here normally 10-20 mm. Because of this relatively small dimension, the filament bundle in the stretching unit is compacted relatively strongly. This has the disadvantage, in many known installations, that the filaments can be separated only with considerable difficulty for deposition as individual filaments.

OBJECTS OF THE INVENTION

It is therefore an object of the present invention to provide an improved apparatus for making filaments for formation of a spunbond web.

Another object is the provision of such an improved apparatus for making filaments for formation of a spunbond web that overcomes the above-given disadvantages, in particular that produces a filament bundle that can be separated in a simple and effective manner into individual filaments that can then be deposited for the spunbond web.

SUMMARY OF THE INVENTION

An apparatus for making a spunbond web has according to the invention a deposition surface, a spinneret above the surface for producing filaments that move downward along a path toward the surface, and a cooling chamber below the spinneret. Cool process air is supplied to the chamber to cool the filaments as they pass downward through the chamber. A laterally closed stretching unit downstream of the cooling chamber has laterally closed side walls that have portions that diverges downward. A connecting region between the stretching unit and the cooling chamber substantially excludes access of air from outside to the filaments as they pass from the cooling chamber to the stretching unit so that the filaments drop from the stretching unit onto the deposition surface.

A spinneret spins the filaments that are then fed through the cooling chamber in which they are cooled. It is within the scope of the invention that the cooling chamber is a closed chamber that, in addition to the process air intake, and in addition to the inlet opening and outlet opening for the filament band, is closed or substantially closed. According to the invention, the connection region between the cooling chamber and the stretching unit is laterally closed. In the connection region or the transition region between the cooling chamber and the stretching unit there is thus, according to the invention, no air feed or substantially no air can get into the system or gain access to the flow path of the filaments.

In the context of the invention, a diverging design of the passage walls of the stretching passage means in particular that the passage walls diverge transversely to the normally vertical filament-travel or transversely to the spunbond web. The spacing between these passage walls increases in the diverging portion in the direction toward the depositing device. The length of the stretching passage moreover means the extent of the stretching passage between the cooling chamber and the depositing device.

A greatly preferred embodiment of the invention is characterized in that the cooling chamber is subdivided into at least two cooling compartments fed with process air at different temperatures. This special embodiment has been found to be particularly advantageous in the scope of the invention. According to an embodiment, the temperature of the supplied process air in the upstream or upper cooling compartment is higher than the temperature of the supplied process air in the lower or downstream cooling compartment. The upstream or upper cooling compartment here relates to the cooling compartment that the filaments enter first.

According to the invention, the connection region between the cooling chamber and the stretching unit is closed. The stretching unit is thus connected to the cooling chamber such that no introduction of air or substantially no introduction of air takes place in the connection region between the cooling chamber and the stretching unit. The stretching unit can here be connected directly to the cooling chamber without any air-feed slit. According to a third embodiment of the invention, an intermediate passage is arranged between the cooling chamber and the stretching unit. Here, the fact that no air is introduced from the outside or substantially no air is introduced from the outside into this intermediate passage falls within the scope of the invention. This means that only the process air from the cooling chamber can get into the intermediate passage and that otherwise no air introduction or substantially no air introduction from the outside takes place. It is preferred for the intermediate passage to have a converging shape from the cooling chamber to the stretching unit.

Here, the intermediate passage walls, which are spaced transversely to the machine direction or transversely to the travel direction of the spunbond web, converge. The intermediate passage thus narrows from the cooling chamber to the stretching unit. According to an embodiment of the invention, different convergence angles of the intermediate passage can be used. The fact that the lower end of the intermediate passage is connected to the stretching passage of the stretching unit without an intake slit for air or substantially without an intake slit for air falls within the scope of the invention. Thus, only the process air (with the filaments), and no additional air or substantially no additional air, reaches the stretching passage from the intermediate passage.

However, it is recommended that in the stretching unit, at the upstream end of the diverging stretching passage section or slightly upstream of the diverging stretching passage section, additional air is injected into the stretching passage. Here, the air is advantageously injected or allowed to enter by jet entrainment parallel to the travel direction of the filaments or the filament bundle, and preferably tangentially to the filament bundle. The air is blown in tangentially and preferably as a boundary layer. It is recommended that the air injection be from opposite facing passage walls or facing diverging passage walls of the stretching passage and, here, preferably at the same height with respect to the length of the stretching passage. Such a two-sided air feed can also take place twice or repeatedly at different heights of the stretching passage. The air injection takes place advantageously with the condition that the filament bundle is made broader in the machine direction or in the travel direction of the spunbond web. In this process, it is preferred to operate in such a way that the opening angle of the filament bundle is 0.1-10°, preferably 0.1-1°.

The expression "at the upstream end of the diverging stretching passage section" means in particular the upstream third, preferably the upstream fourth, and particularly preferably the upstream fifth of the diverging stretching passage section, with respect to the length of the diverging stretching passage section. The spacing between the passage walls of the stretching passage is advantageously 5-30 mm, preferably 8-25 mm, and most preferably 10-20 mm.

It is within the scope of the invention that at least one fourth, preferably at least one third of the length of the stretching passage diverges or is designed as a diverging portion. At least 40% of the length of the stretching passage is preferably diverging or has a diverging flow cross section. According to a first preferred embodiment of the invention, the stretching passage has diverging passage walls over its entire length or substantially over its entire length. According to this embodiment, the entire stretching passage or substantially the entire stretching passage diverges. It falls within the scope of the invention for the stretching passage to diverge over at least 90%, preferably over at least 95% of its length.

According to an additional preferred embodiment of the invention, the stretching passage has over a part of its length parallel passage walls (parallel section) and downstream of this part are diverging passage walls (diverging portion). Here, it falls within the scope of the invention that the stretching passage in this embodiment consists exclusively of the mentioned parallel section and the downstream diverging portion. The additional air feed takes place in this embodiment either at the end of the parallel section or at the upstream end of the diverging portion of the stretching passage. The end of the parallel passage here refers in particular to the downstream third with respect to the length of the parallel section, preferably the farthest downstream fourth, and most preferably the farthest downstream fifth of the parallel section. The upstream end of the diverging portion here and below means in particular the farthest upstream third with respect to the length of the diverging portion, preferably the farthest upstream fourth, and most preferably the farthest upstream fifth of the diverging portion. It is preferred for the diverging portion of this embodiment to be longer than the parallel section, the diverging portion being advantageously at least 1.5 times the length of the parallel section.

According to a preferred embodiment of the invention, the stretching passage has converging passage walls (converging section) over part of its length, which are then followed by diverging passage walls (diverging portion). Here, it falls within the scope of the invention that the stretching passage in this embodiment consists exclusively of the converging and the diverging portion. Thus, the diverging portion is immediately downstream of the converging section. In this embodiment, the additional air feed is advantageously in the transitional region between the converging section and the diverging portion, or at the upstream end of the diverging portion. It is advantageous in this embodiment for the diverging portion to be longer than the converging section, and the diverging portion is preferably 1.5 times the length of the converging section.

According to an additional embodiment of the invention, the stretching passage has over a part of its length converging walls (converging section), downstream of which are parallel passage walls (parallel section), and downstream of which in turn are diverging passage walls (diverging portion). According to an embodiment, the stretching passage here consists exclusively of the converging section, the next downstream central parallel section, and in turn the next downstream diverging portion. However, in principle, the last-mentioned diverging portion can also be a downstream parallel section. In this embodiment, the additional air feed takes place advantageously at the end of the (upstream) parallel section or at the upstream end of the diverging portion. The end of the parallel section means the farthest downstream third, preferably the farthest downstream fourth, and most preferably the farthest downstream fifth of the parallel section, with respect to the length of the parallel section. In this embodiment (converging-parallel-diverging), it is recommended for the diverging portion to be the longest passage section. This means that the diverging portion in each case is longer than the parallel section and longer than the convergent section. According to a particularly recommended embodiment, the diverging portion is longer than the total passage section consisting of the converging and parallel section.

According to a preferred embodiment of the invention, the diverging passage walls of the diverging portion are in an arrangement that is symmetric with respect to a middle plane that runs vertically through the stretching passage. In principle, the scope of the invention also includes that the diverging passage walls can be arranged asymmetrically with respect to this middle plane. In that case, one of the two diverging passage walls would thus have a stronger inclination or slanted position than the other facing passage wall. According to a preferred embodiment of the invention, the divergence angle of the diverging portion remains constant over the length of the diverging portion. However, in principle, it is also possible for the divergence angle to change over the length of the diverging portion.

It falls within the scope of the invention that the cooling chamber and the stretching unit of the apparatus according to the invention form a closed unit. Here, air feed into the aggregate consisting of the cooling chamber and the stretching unit is limited at least substantially to the introduction of the process air into the cooling chamber, on the one hand, and to the additional air fed in upstream of the diverging portion or at the upstream end of the diverging portion in the stretching passage, on the other hand. Naturally, air can also reach the cooling chamber from above with the deposition belt.

A particular embodiment, which is particularly important within in the scope of the invention, is characterized in that downstream of the stretching unit a repositioning unit with at least one diffuser. Thus, the filaments are, or the filament bundle is, led through at least one diffuser after the stretching unit. The diffuser has at least regions with diverging diffuser walls. The diffuser walls are here spaced transversely to the machine direction or transversely to the travel direction of the spunbond web. According to a recommended embodiment, the repositioning unit consists of an upstream diffuser and a next downstream diffuser. It is advantageous to provide an ambient air inlet slit between the upstream diffuser and the downstream diffuser. Because of the exit pulse from the upstream diffuser, air is sucked out of the environment through this ambient air inlet slit. The width of the ambient air inlet slit is advantageously adjustable.

It is within the scope of the invention that the depositing device of the apparatus according to the invention is a continuously moving foraminous deposition belt for the spunbond web. At least one suction apparatus is advantageously provided under the foraminous deposition belt, by means of which air can be sucked through the foraminous deposition belt.

The invention is based on the discovery that a very high-quality spunbond web can be manufactured with the apparatus according to the invention, which is characterized particularly by a homogeneous structure and homogeneous properties. The invention is based particularly on the discovery that, as a result of the design of the stretching unit according to the invention, undesired compaction of the filament bundle can be avoided or any compaction that has already occurred can be reduced greatly. The treatment according to the invention of the filament bundle can result in an effective spacing between the individual filaments. Thus, with the design according to the invention, a high number of filaments can be deposited in the form of individual filaments. As a result, the quality of the spunbond web manufactured according to the invention can be increased considerably in comparison to a spunbond web manufactured according to the prior art. Moreover, it should be emphasized that the success according to the invention can be achieved using relatively simple and cost effective measures. As a result, a high quality spunbond web can be obtained with even or homogeneous structural properties.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
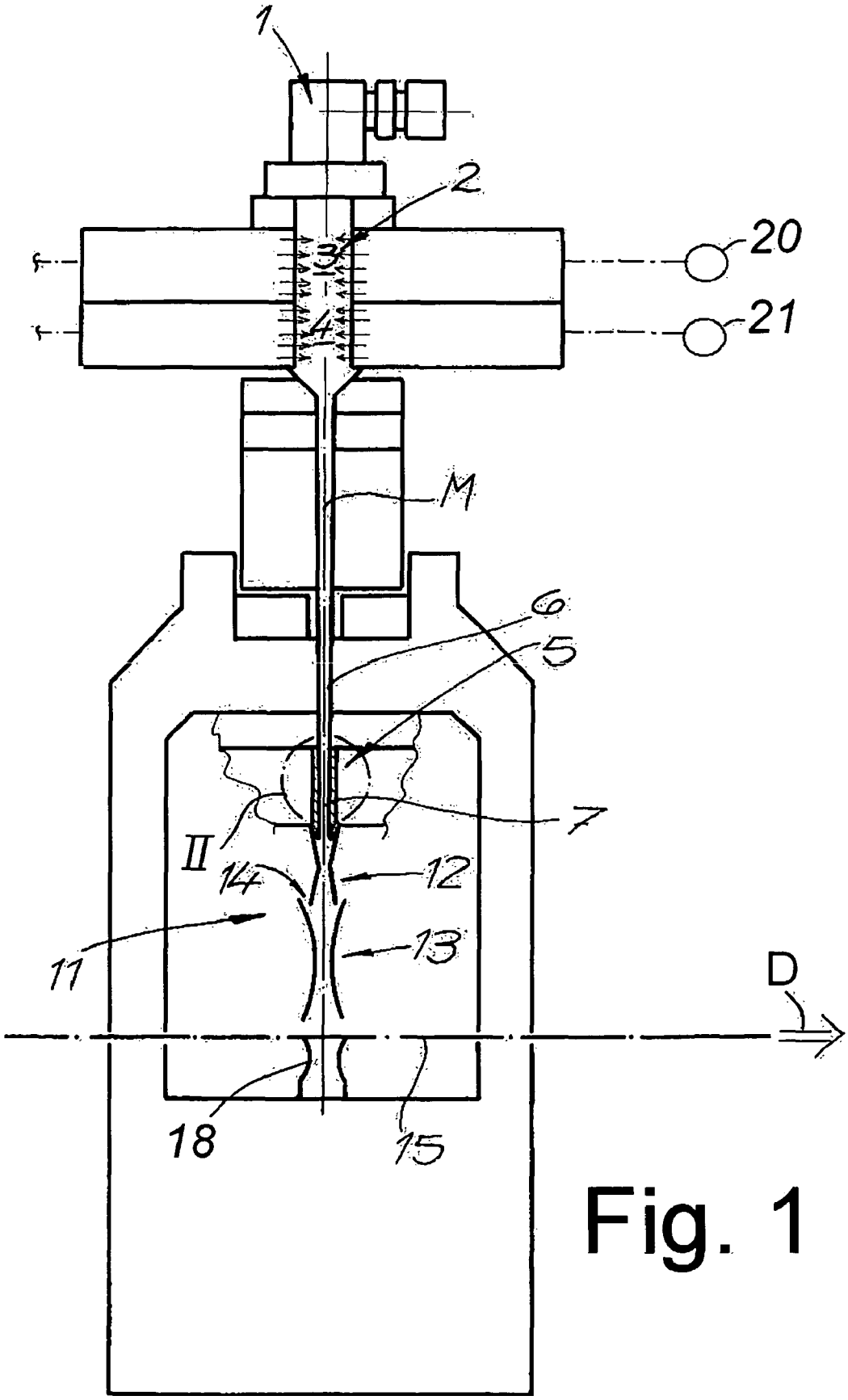
FIG. 1 is a vertical section through an apparatus according to the invention.

As seen in FIG. 1 an apparatus for the continuous manufacture of a spunbond web from aerodynamically stretched filaments made of a thermoplastic resin has a downwardly directed spinneret 1 for extruding hot thermoplastic filaments F that move downward along a vertically extending flow path M. Downstream of the spinneret 1 is a cooling chamber 2 that is supplied with cool process air to cool the filaments F. The cooling chamber 2 is here preferably subdivided into two cooling compartments 3 and 4, in which the filaments F are cooled with process air at a different temperatures coming from respective supplies 20 and 21. According to a preferred embodiment of the invention, the temperature of the process air that is applied to the filaments F in the upstream cooling compartment 3 is higher than the temperature of the process air that is applied to the filaments F in the downstream cooling compartment 4.

Downstream of the cooling chamber 2 is a stretching unit 5 that aerodynamically longitudinally stretches the filaments F. Preferably, as in the illustrated embodiment, the cooling chamber 2 is connected here via an intermediate passage 6 to the stretching unit 5. The connection region between the cooling chamber 2 and the stretching unit 5 defining this passage 6 is laterally closed. This means that in this transition region and particularly in the region of the intermediate passage 6, substantially no air can enter the flow path of the filaments F from outside. Advantageously, as in the illustrated embodiment, the intermediate passage 6 has a downward converging shape from the cooling chamber 2 to the stretching unit 5. In other words, the intermediate passage 6 narrows or is of decreasing flow cross section from the cooling chamber to the stretching unit 5.

According to the invention, the stretching unit 5 has a stretching passage 7 whose walls 8 and 9 diverge over at least a part of the length of the stretching passage 7, so that its flow cross section increased going downward over at least a portion 10 of its vertical length.

In FIG. 1, it is apparent that downstream of the stretching unit 5 is a depositing unit 11 that consists preferably, as in the illustrated embodiment, of an upstream diffuser 12 and a downstream diffuser 13. Moreover, one can also see in FIG. 1 that an ambient air intake slit 14 is provided between the upstream diffuser 12 and the downstream diffuser 13. Each diffuser 12 and 13 has an upper converging part as well as a lower diverging portion. Accordingly, each diffuser 12 and 13 has a narrowest region between the upper converging part and the lower diverging portion. It is advantageous for the diffuser walls in the diverging portion of the upstream diffuser 12 and/or the downstream diffuser 13 to be adjustable, so that the apex angle of the respective diverging portions are adjustable.

Under the depositing unit 11, a continuously moved foraminous deposition belt 15 is provided, as a deposition surface for the spunbond web. Beneath this foraminous deposition belt 15, at least one suction apparatus 18 is provided advantageously, by means of which air can be drawn down through the foraminous deposition belt 15 in the usual way. The deposition surface 15 moves off in a horizontal direction D to carry away the mat of filaments F that is subsequently compressed and otherwise treated, e.g. by hydrodynamic needling.

FIGS. 2-5 show the third embodiments for the design of the stretching passage 7 of the stretching unit 5. In all these illustrated embodiments, additional air is blown into the stretching passage 7 at the upstream end of the diverging stretching passage section or at the upstream end of the diverging portion 10 or shortly before the diverging portion 10. The introduction of the air here takes place advantageously in the direction of travel of the filaments F or of the filament bundle, and preferably tangentially to the filaments F or to the filament bundle. As can be seen in FIGS. 2-5, the air injection takes place preferably from both facing passage walls 8 and 9 and, here, level with the stretching unit 5. Here, it falls within the scope of the invention that air is blown in with the condition that the filament bundle is made broader, where the opening angle of the filament bundle is preferably 0.1-1°. This broadening of the filament bundle is indicated in FIGS. 2-5.

To the extent that here and below the expression upstream end of the diverging portion 10 is used, it refers particularly to the upstream third, preferably to the upstream fourth, and most preferably to the upstream fifth of the diverging portion 10, with respect to the length of the diverging portion 10.

Figure 2:
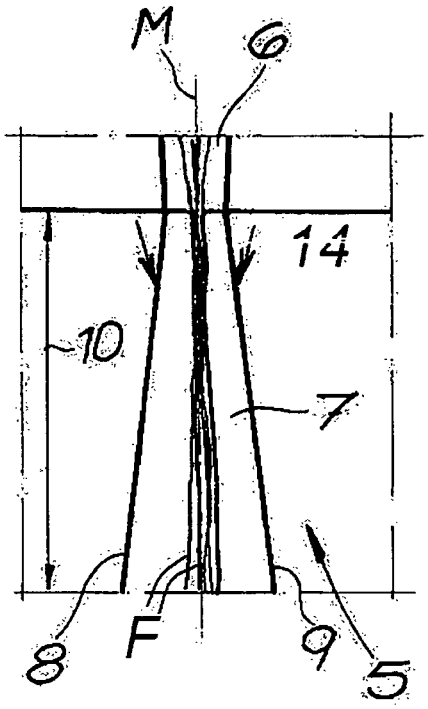
FIG. 2 shows in enlarged scale the detail shown at II of FIG. 1.

FIG. 2 shows a first embodiment of the stretching unit 5 according to the invention, where the stretching passage 7 has passage walls 8 and 9 that diverge over their entire length. In other words, the entire stretching passage 7 diverges downward. The air intake 14 here is at the upstream end of the diverging stretching passage 7. The passage walls 8 and 9 are symmetrical to a middle plane including the axis of the path M. In addition, the divergence angle between the passage walls 8 and 9 remains constant over the length of the stretching passage 7.

Figure 3:
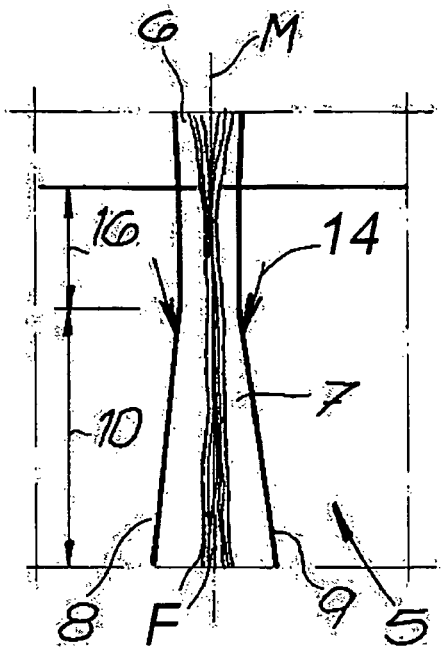
FIG. 3 shows a second embodiment of the structure according to FIG. 2.

In the illustrated embodiment according to FIG. 3, the stretching passage 7 has an upstream section 16 with parallel passage walls 8 and 9, downstream of which is the diverging portion 10. The air intake 14 here is at the upstream end of this diverging portion 10. It is apparent in FIG. 3 that the diverging portion 10 is longer than the parallel section 16, namely approximately twice as long. In the embodiment according to FIG. 3, the passage walls 8 and 9 in the diverging portion 10 are also symmetrical to the middle plane M, and the divergence angle remains constant over the entire length of the diverging portion 10.

Figure 4:
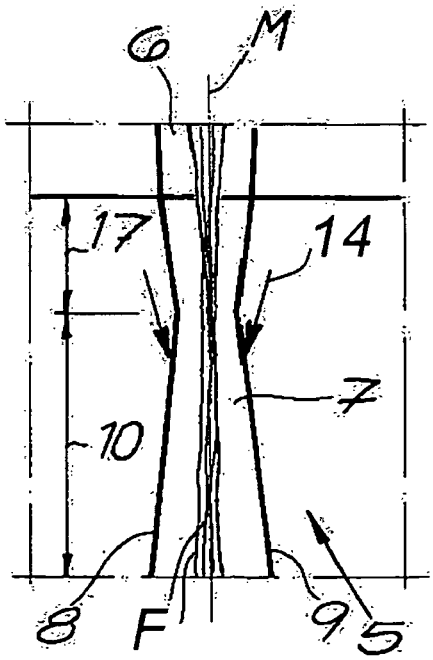
FIG. 4 shows a third embodiment of the structure as in FIG. 2.

FIG. 4 shows an embodiment in which the stretching passage 7 has an upstream section 17 with converging passage walls 8 and 9, immediately downstream of which is the diverging portion 10. The air intake 14 here too is at the upstream end of the diverging portion 10. The diverging portion 10, in the illustrated embodiment according to FIG. 4, is longer than the converging section 17, namely approximately twice as long.

Figure 5:
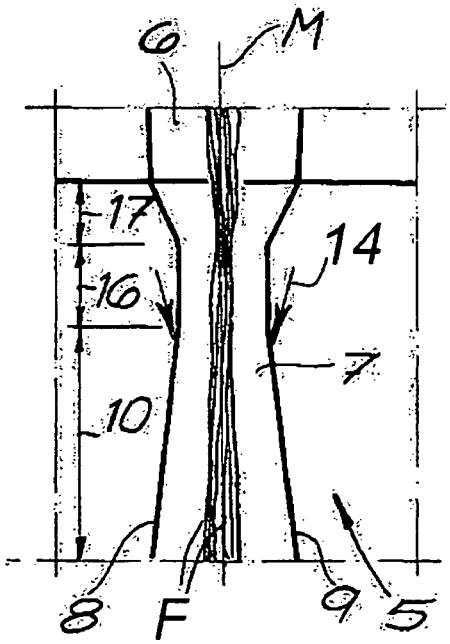
FIG. 5 shows a fourth embodiment of the structure as in FIG. 2.

FIG. 5 shows an embodiment of the stretching unit 5 in which the stretching unit 7 has an upstream converging section 17 with converging passage walls 8 and 9, downstream of which is a parallel section 16. Directly downstream of the parallel section 16 is the diverging portion 10. The air intake 14 here too is at the upstream end of the diverging portion 10. The length of the diverging portion 10, in the illustrated embodiment, is greater than the length of the remaining stretching passage 7 consisting of the converging section 17 and the parallel section 16. In the diverging portion 10, the passage walls 8 and 9 are symmetrical to the middle plane. The divergence angle remains constant over the length of the diverging portion 10.

We claim:

1. An apparatus for making a spunbond web, the apparatus comprising:

a deposition surface;

means including a spinneret above the surface for producing a bundle of filaments that move downward along a path toward the surface;

a cooling chamber below the spinneret;

means for supplying cool process air to the chamber and thereby cooling the filaments as they pass downward through the chamber;

a laterally closed stretching unit downstream of the cooling chamber having laterally closed side walls that have portions that diverges downward;

a connecting region between the stretching unit and the cooling chamber substantially excluding access of air from outside to the filaments as they pass from the cooling chamber to the stretching unit, the cooling chamber, connecting region, and stretching unit being aligned vertically such that the bundle of filaments drops through the chamber, the region, and the unit onto the deposition surface; and means including an intake opening generally at an upstream end of the diverging portions of the walls of the stretching unit for injecting outside air into the stretching unit and thereby separating the filaments and broadening the bundle of filaments in the stretching unit.

2. The apparatus defined in claim 1 wherein the cooling chamber is subdivided into at least two cooling compartments, the apparatus further comprising means for supplying process air at different temperatures to the compartments.

3. The apparatus defined in claim 1, further comprising an intermediate passage between the cooling chamber and the stretching unit and of converging flow cross section from the cooling chamber to the stretching unit.

4. The apparatus defined in claim 1 wherein the stretching unit has upright walls that diverge substantially their entire length along the path.

5. The apparatus defined in claim 1 wherein the stretching unit has upright walls with downstream portions that diverge and upstream portions that are generally parallel.

6. The apparatus defined in claim 1 wherein the stretching unit has upright walls with downstream portions that diverge and upstream portions that converge.

7. The apparatus defined in claim 1 wherein the stretching unit has upright walls with downstream portions that diverge, upstream portions that converge, and central portions that are generally parallel.

8. The apparatus defined in claim 1, further comprising a diffuser downstream of the stretching unit and above the surface.

9. The apparatus defined in claim 8 wherein the diffuser has an upstream part and a separate downstream part and means forming an air-intake slot between the parts.

10. The apparatus defined in claim 1 wherein the surface is formed by a horizontally moving stretch of a belt.

* * * * *